US005772369A

United States Patent [19]

Lerman et al.

[11] Patent Number: 5,772,369

[45] Date of Patent: Jun. 30, 1998

[54] AIR CARGO RESTRAINT SYSTEM AND FITTINGS THEREFOR

[75] Inventors: Shmuel Lerman, Ramat Gan; Oded Freedman, Tel Aviv; Adi Shargil, Gedera, all of Israel

[73] Assignee: S.F.A. Engineering 92 Ltd., Ramat Gan, Israel

[21] Appl. No.: 370,572

[22] Filed: Dec. 19, 1994

Related U.S. Application Data

[63] Continuation of PCT/GB93/01073 filed May 25, 1993.

[30] Foreign Application Priority Data

Jun. 24, 1992 [IL] Israel ..... 102308

[51] Int. Cl.[6] ..... B65D 19/00

[52] U.S. Cl. ..... 410/96; 206/597; 108/55.5

[58] Field of Search ..... 410/117, 155, 410/156, 96; 108/55.1, 55.5; 206/386, 597; 244/118.1

[56] References Cited

U.S. PATENT DOCUMENTS

| | | | |
|---|---|---|---|
| 3,556,448 | 1/1971 | Dobbs | 206/597 |
| 4,206,846 | 6/1980 | Connolly | 108/55.1 |
| 4,270,657 | 6/1981 | Boyan | 108/55.5 |
| 4,868,955 | 9/1989 | Magnant et al. | 206/597 |
| 4,998,619 | 3/1991 | Sowa et al. | 206/386 |
| 5,388,702 | 2/1995 | Jones | 206/597 |

*Primary Examiner*—Karen B. Merritt
*Assistant Examiner*—Gregory A. Morse
*Attorney, Agent, or Firm*—Darby & Darby

[57] ABSTRACT

A fitting for anchoring a flexible covering to a planar, air cargo sheet pallet, the fitting including a base portion adapted for mating engagement with a selected mounting portion of a planar sheet pallet; and gripping apparatus, attached to the base portion, for grippingly engaging a portion of the flexible covering so as to anchor it to the pallet, thereby to restrain cargo located thereon in a preselected position when subjected to in-flight dislodgement forces.

31 Claims, 12 Drawing Sheets

AIR CARGO RESTRAINT SYSTEM AND FITTINGS THEREFOR

This is a continuation of international application Serial No. PCT/GB93/01073, filed May 25, 1993.

FIELD OF THE INVENTION

The present invention is concerned with a novel air cargo restraint system and fittings for use with pallets used in air cargo transport.

BACKGROUND OF THE INVENTION

It is known to ship cargo by aircraft on purpose-made pallets. These pallets are typically flat metal sheets which rest directly on the ground and are lifted and moved around by forklift trucks with their forks placed directly underneath the sheet. Thus they differ from pallets made of wood, plastic or paper, used for non-air shipment purposes, whose floors are generally raised above the group with channels between the floor and the ground, in which to insert the lift forks of the forklift trucks.

A requirement when using pallets for air cargo is to fasten the cargo securely to the pallet, so that the cargo does not become dislodged therefrom die to the vibrations and high acceleration forces to which it is subjected in flight. The acceleration forces are known to reach in excess of 3 G's.

Furthermore, since the air cargo pallets are flat metal sheets and rest directly on a floor surface, thereby preventing access to a bottom surface thereof, they require special anchoring apparatus for tying down the cargo.

Metal air cargo pallets are commonly provided with tracks along their edges. Purpose-manufactured ring-ended fittings are adapted for releasable anchoring into the tracks. Cargo, usually in boxes, is placed on a pallet and a covering, typically in the form of straps or netting, is spread over the cargo and tied or hooked on to the ring end of the fittings. The covering is then further tightened via "C" hooks, for example.

This procedure of spreading the net and tightening it is conducted manually, generally by two to three workers, and usually takes at least twenty minutes to complete. If the net happens to become entangled, which is sometimes the case when taking the net out from the container in which it is stored, the process can take even longer.

For transportation of cargo by means other than by air, it is known to secure cargo onto wooden, plastic or paper pallets by stretch wrapping a plastic film around the cargo and pallet to prevent dislodgement of the cargo therefrom. This can be done by robot wrapping machines which are programmed to wind a stretch wrap plastic film of about 0.5 to 1.0 meters in width around the pallet and the cargo.

The actual wrapping can be performed by either placing the loaded pallet on a turntable with the robot remaining stationary, and as the turntable rotates, the wrapping film is tightened around the cargo. Alternatively, a mobile robot can be used which travels around the cargo while wrapping the film.

SUMMARY OF THE INVENTION

The present invention aims to provide a system for securing loads on to flat pal lets quickly and inexpensively and so as to withstand the rigors encountered in air transport.

It is a further object of the invention to provide an anchor fitting for use with a system of securing a load on to an air cargo flat sheet metal pallet.

Yet a further object of the invention is to provide a method for securing a load on to an air cargo flat sheet metal pallet.

Thus there is provided, in accordance with one aspect of the invention, a cargo restraint system which comprises:

a planar sheet pallet having edge portions and having mounting means located along said edge portions; and means for securing cargo to said pallet, wherein the improvement comprises:

a wrap around tensionable flexible covering placed tightly around in movement restraining contact with the cargo located on said pallet; and anchor means, adapted for mating engagement with said mounting means of said pallet, and having at least one grip surface adapted to directly grip a lower edge portion of said tensionable covering thereby to anchor said covering to said pallet, so as to maintain the cargo in a preselected position on said pallet.

Further in accordance with another aspect of the invention, there is provided an apparatus for anchoring a wrap around tensionable flexible covering to edge portions of a planar sheet pallet adapted in use to support cargo thereon and having edge portions, the tensionable flexible covering being retained in movement restraining contact with the cargo, said apparatus comprising:

mounting means located along the edge portions of a planar sheet pallet; and anchor means adapted for mating engagement with said mounting means of the pallet and having at least one grip surface adapted in use to directly grip a lower edge portion of said tensionable covering thereby to anchor said covering to the pallet, thereby to maintain cargo located thereon in a preselected position.

Additionally, in accordance with an embodiment of the invention, the anchor means is adapted for releasable locking engagement with the mounting means.

Further in accordance with an embodiment of the invention, the anchor means also includes a recessed portion adapted to receive tucked-in edge portions of the tensionable flexible covering.

Additionally in accordance with an embodiment of the invention, the anchor means includes a plurality of fittings, each defining generally an outward-facing grip surface and a recessed portion which are together adapted to tightly engage edge portions of the flexible covering so as to anchor it to the pallet.

In accordance with an alternative embodiment of the invention, the anchor means comprises means for applying a generally downward tension force to the flexible covering, preferably in response to engagement thereby.

There is also provided, in accordance with a further aspect of the invention, a fitting for anchoring a tensionable flexible covering to a planar sheet pallet in movement restraining contact with a cargo located on the pallet, said fitting comprising:

a base portion adapted in use for mating engagement with a selected mounting portion of a planar sheet pallet; and gripping means attached to said base portion having at least one grip surface adapted in use to directly grip a lower edge portion of the tensionable covering thereby to anchor the covering to the pallet, so as to maintain the cargo in a preselected position on the pallet.

In accordance with a yet further aspect of the invention, there is provided a method of securing a cargo to a planar sheet pallet so as to withstand forces seeking to dislodge the cargo therefrom when the pallet is in motion, which comprises the steps of:

placing cargo on to the pallet;

arranging a plurality of anchor fittings, each having one or more grip surfaces, along predetermined peripheral portions of the pallet externally of the cargo; and wrapping a tensionable flexible covering around the cargo and around the anchor fittings so as to be in movement restraining contact with the cargo, and so as to cause direct gripping engagement of a lower edge portion of the tensionable flexible covering by the grip surfaces of the anchor fittings, thereby restraining the cargo on the pallet against dislodgement forces when in motion.

BRIEF DESCRIPTION OF THE DRAWINGS

The present invention will be better understood and appreciated from the following detailed description, taken in conjunction with the drawings in which.

DETAILED DESCRIPTION OF THE INVENTION

Figure 1A:
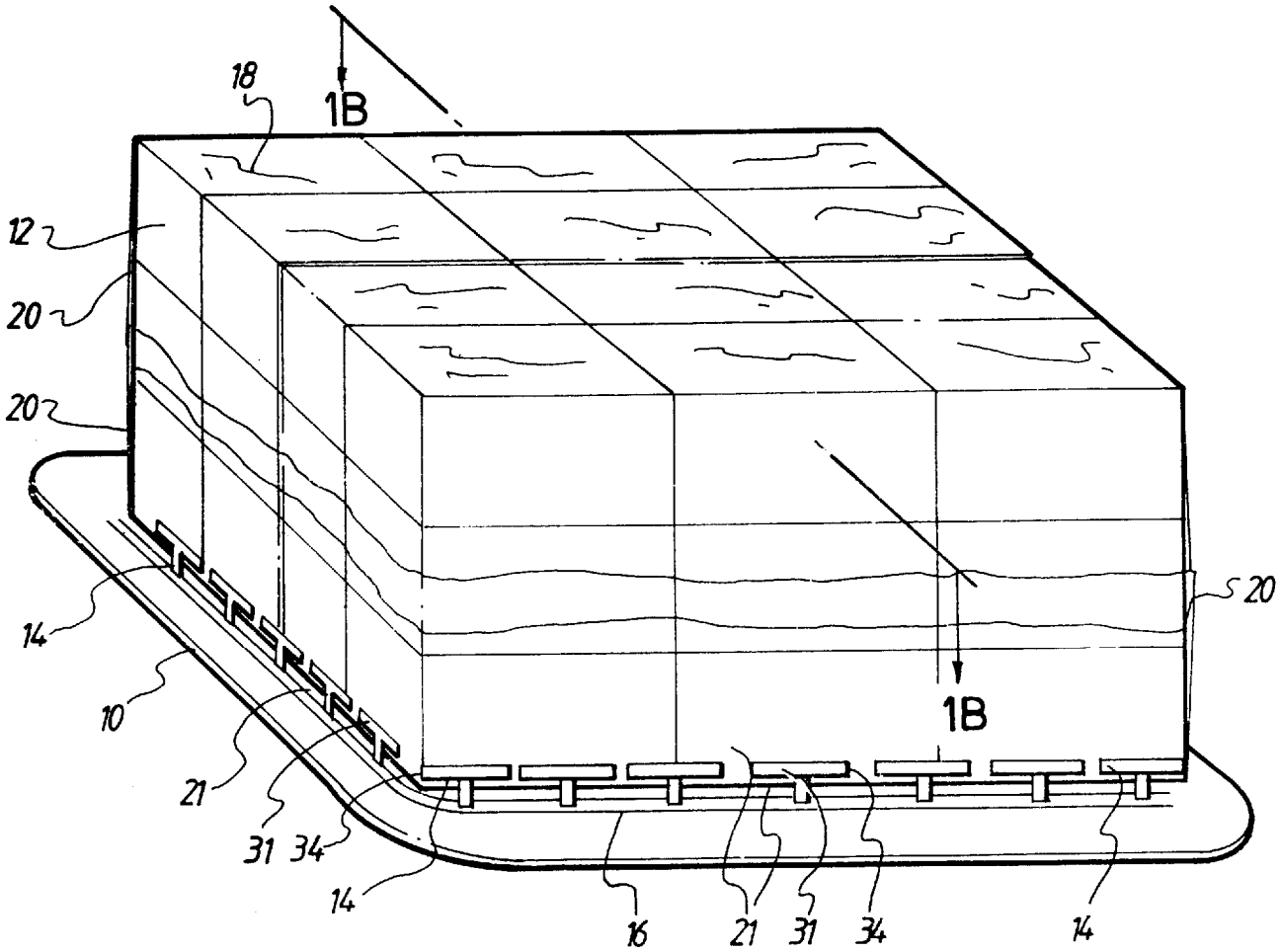
FIG. 1A is a general view of cargo secured to a flat metal pallet in accordance with an embodiment of the present invention.
Figure 1C:
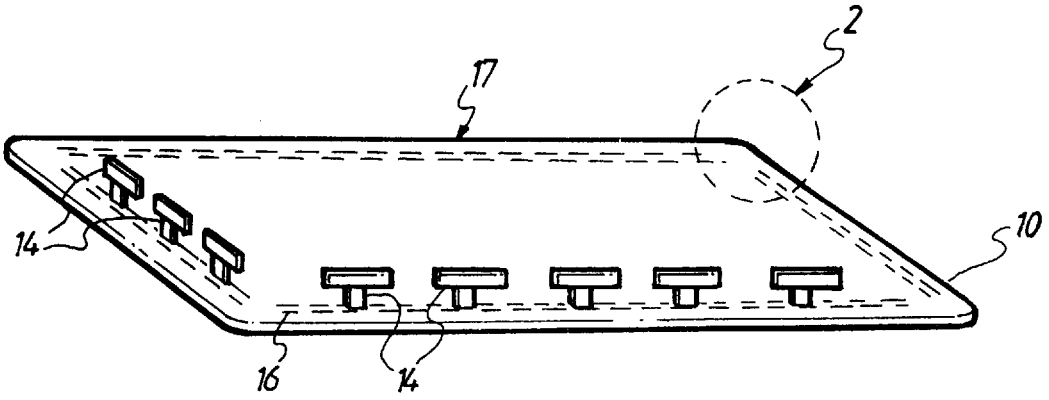
FIG. 1C is a schematic illustration of a flat metal pallet to which a plurality of anchor fittings have been attached in accordance with an embodiment of the invention.
Figure 1B:
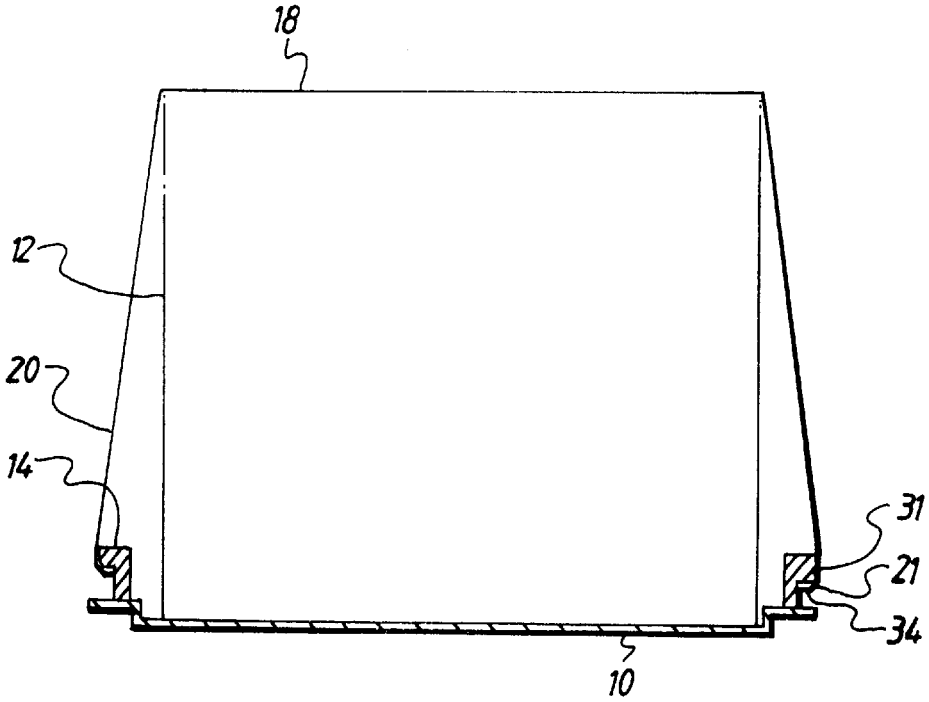
FIG. 1B is a generalized cross-sectional view of the cargo and pallet of FIG. 1A, taken along line 1B—1B therein.

Referring now to FIGS. 1A and 1B, there is illustrated an air cargo restraint system in accordance with an embodiment of the present invention. The system includes a flat sheet air cargo pallet 10 with a cargo 12 of cartons secured thereon in accordance with the invention. As seen most clearly in FIG. 1C, a plurality of anchor fittings 14 are mounted onto pallet 10 via a track 16.

A plastic sheet 18 covers an upper portion of cargo 12, and extends downward, partly covering generally vertical sides thereof. A tensioned wrap around flexible covering 20 is provided so as to extend about the sides of cargo 12 and such that lower edge portions thereof are grippingly engaged by anchor fittings 14. More precisely, and as seen in FIG. 1B, flexible covering 20 is applied such that lower edge portions thereof, referenced generally 21 (FIGS. 1A and 1B), become tightly engaged with grip surfaces 31 and become tucked into recessed portions 34 of anchor fittings 14. Various exemplary constructions of anchor fittings 14 are shown and described hereinbelow in conjunction with FIGS. 3A–9.

It has been found by the inventors that cargo to be shipped by aircraft may be secured to pallet 10 so as to withstand forces seeking to dislodge the cargo therefrom in the manner illustrated in FIGS. 1A and 1B, and substantially as described hereinbelow.

According to one embodiment of the invention, tensioned flexible covering 20 comprises plastic stretch film which is wound about the cargo 12 and pallet 10 several times, thereby to secure the cargo 12 to the pallet, and so as also to engage and secure top covering 18 to the cargo 12 and flexible covering 20.

Alternatively, any suitable flexible covering material having suitable strength and stretch characteristics may be used for flexible covering 20. Accordingly, the flexible covering may be any suitable woven or non-woven flexible sheet material, webbing, synthetic material, or natural material.

It will be appreciated that use of netting or perforated film permits the cargo to be in contact with the atmosphere, which is especially desirable for agricultural products to prevent them from rotting.

Top covering 18 may also comprise a suitable type of netting in place of plastic film. When such netting is used both for the top covering 18 and for the flexible covering 20, it may be desirable to attach the two together, such as by stapling, so as to prevent the cover from becoming loose.

Figure 2:
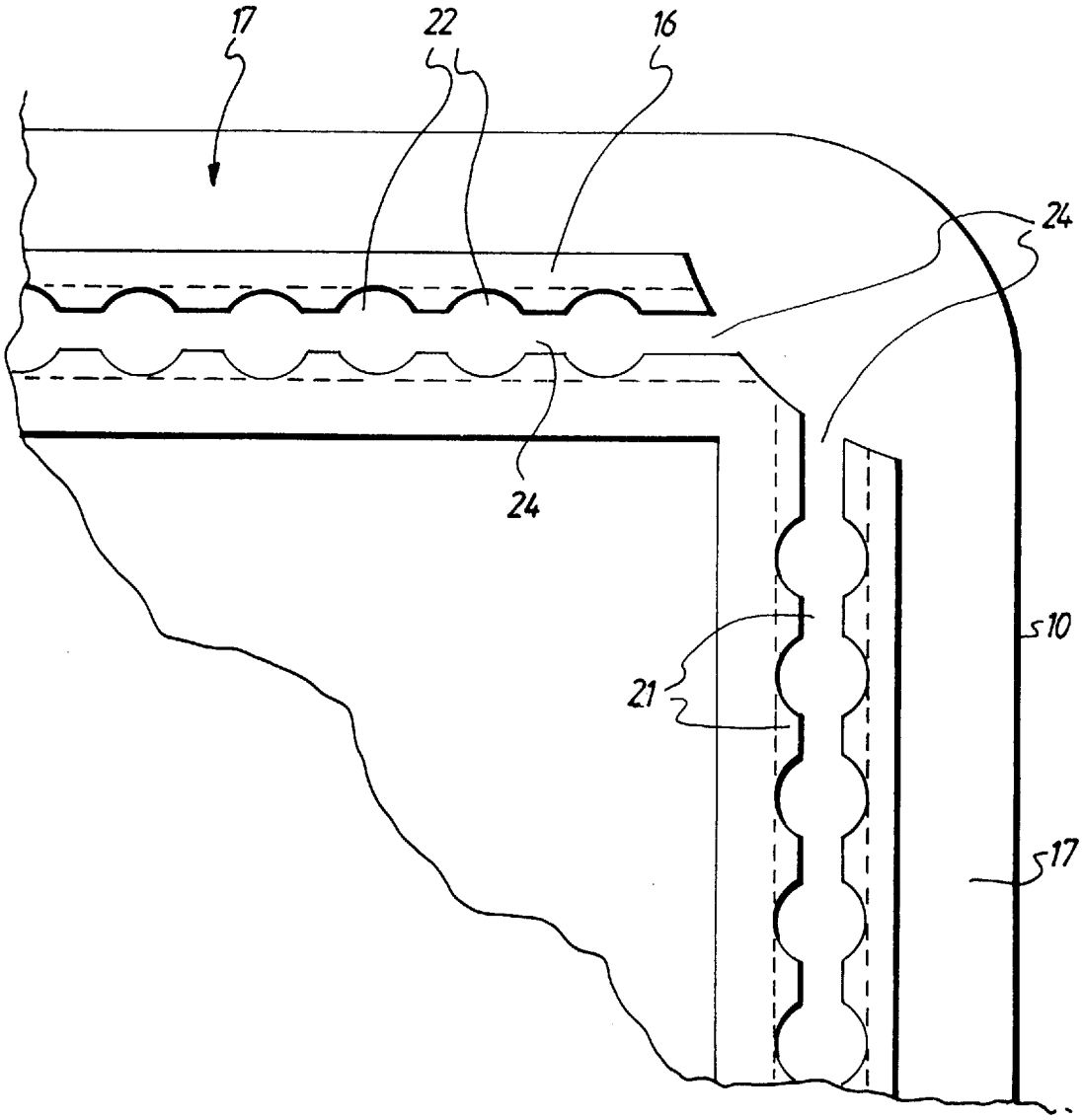
FIG. 2 is an enlarged view of a corner portion of the pallet of FIG. 1B, indicated at area 2 therein.

Reference is now made briefly to FIG. 2, in which is illustrated, in enlarged detail, a corner section of a flat sheet metal pallet 10, such as commonly used in air cargo shipping. As described above in conjunction with FIGS. 1A–1C, pallet 10 has a track 16 which extends along edge portions 17 of pallet 10. Track 16 serves to permit releasable mounting of a suitable configured anchor fitting, as described hereinbelow in conjunction with FIGS. 3A–6B.

Track 16 is typically hollow, defining a channel 21, and is formed so as to have a continuous dumbbell-type configuration, defining a plurality of rounded openings 22 alternating with and connected by elongate openings 24.

Figure 3A:
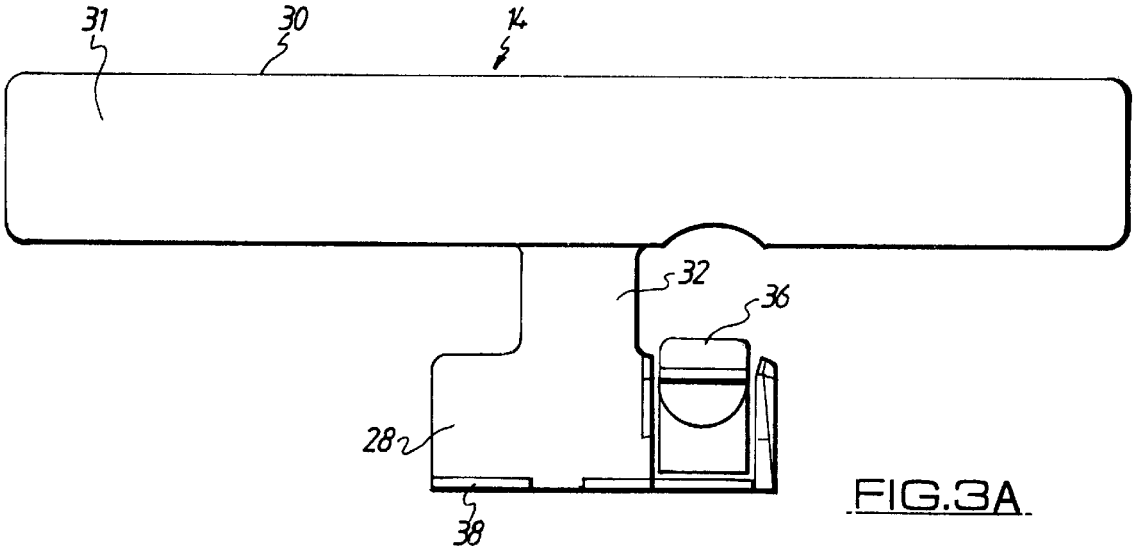
FIGS. 3A–3C are respective schematic front, bottom and side schematic views of an anchor fitting constructed in accordance with an embodiment of the invention.
Figure 3B:
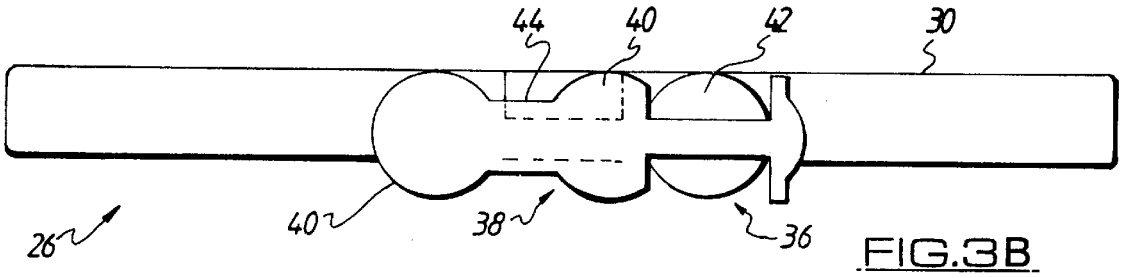
Figure 3C:
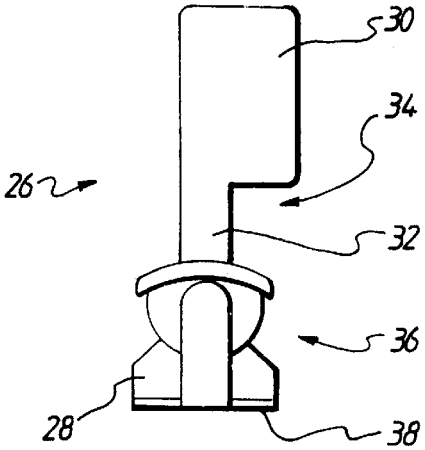

Referring now to FIGS. 3A–3C, in accordance with one embodiment of the invention, anchor fitting 14 is formed as a T-shaped fitting, and comprises a hook portion 30 defining a grip surface 31 configured for engagement and gripping of flexible covering 20 (FIG. 1B), a base portion 28 adapted for releasable locking engagement with track 16 of pallet 10, and an intermediate portion 32 connecting hook portion 30 to base portion 28.

As seen in FIG. 1B, anchor fitting 14 is adapted for mounting in track 16 (FIG. 1C) of pallet 10 such that hook portion 30 protrudes generally outward therefrom, thereby to grip flexible covering 20 via grip surface 31 when the covering is extended thereacross.

As seen in the drawings, base portion 28 includes a pair of generally circular flange portions 40 spaced apart and connected via an elongate web portion 44, such that together, flange portions 40 and web portion 44 have a dumbbell-type configuration adapted to enter corresponding openings 22 and 24 (FIG. 2) defined by track 16.

Base portion 28 also includes a spring biased retainer plug 36 having a key portion 42 which is adapted for entry into a circular opening 22 of track 16. Plug 36 is normally in a lowered position, as illustrated in FIG. 3A, but it can be raised manually to the position illustrated in FIG. 5 against the urging of a compression spring (not shown) located between plug 36 and a portion of the base portion 28.

Mounting of anchor fitting 14 to pallet 10 is now described, in conjunction with FIGS. 4–6B.

Figure 4:
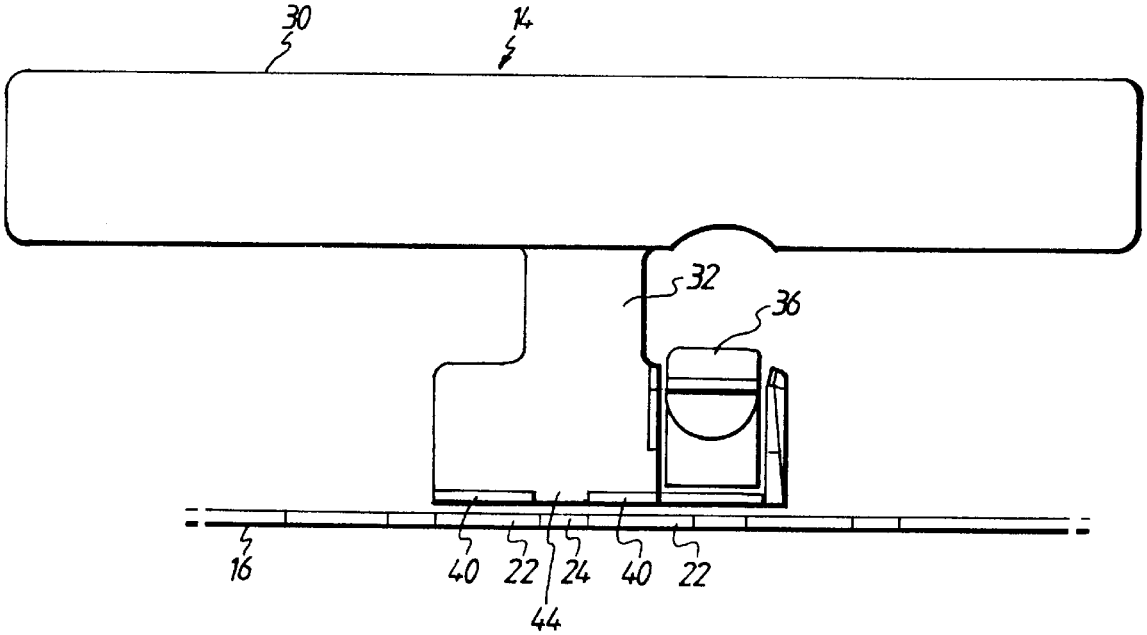
FIG. 4 is a schematic illustration of positioning of an anchor fitting of the invention prior to mounting thereof onto the pallet of FIG. 1C.

Referring now initially to FIG. 4, fitting 14 is shown in a position whereat flange portions 40 and 44 thereof are located in generally vertical registration with respective openings 22 and 24 of track 16.

Figure 5A:
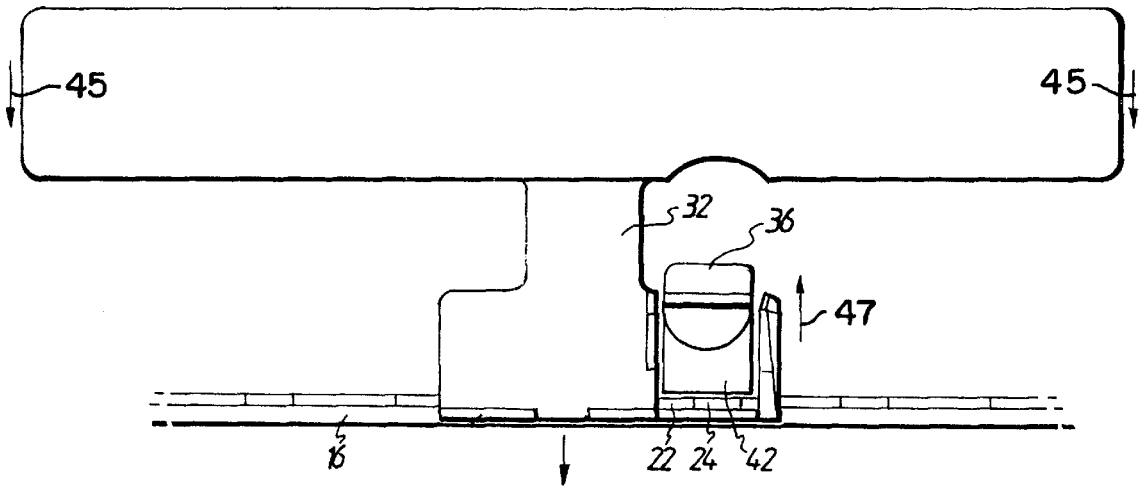
FIGS. 5A and 5B are schematic front and sectional illustrations of the anchor fitting of FIG. 4 in an intermediate mounting position with respect to the pallet.
Figure 5B:
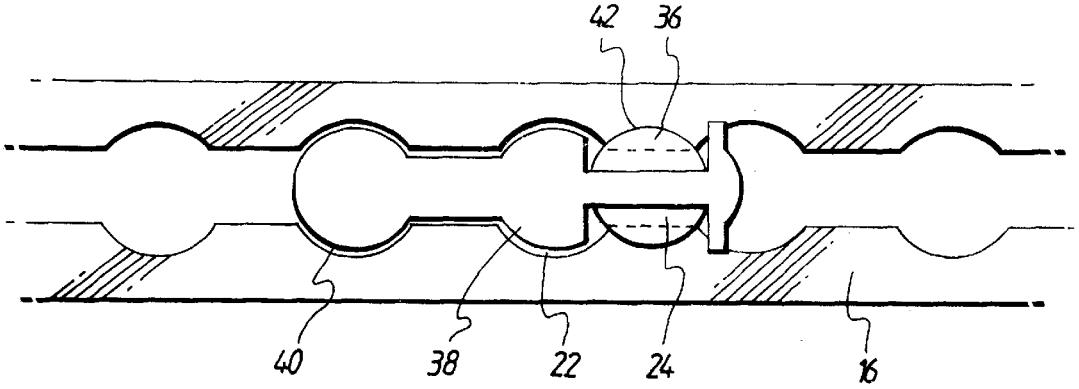

Referring now to FIGS. 5A and 5B, as cylindrical key portion 42 of plug 36 is provided in an out-of-phase position relative to openings 22 and 24 to track 16, in order to insert flange portions 40 and 44 into openings 22 and 24 of track 16, in the direction indicated by arrows 45 (FIG. 5A), plug 36 must be raised in the direction indicated by arrow 47 (FIG. 5A), thereby to raise cylindrical key portion 42 above the level of the track 16. As seen in FIG. 5B, at this stage, flange portions 40 and 44 are in phase with openings 22 and 24 of track 16.

Figure 6A:
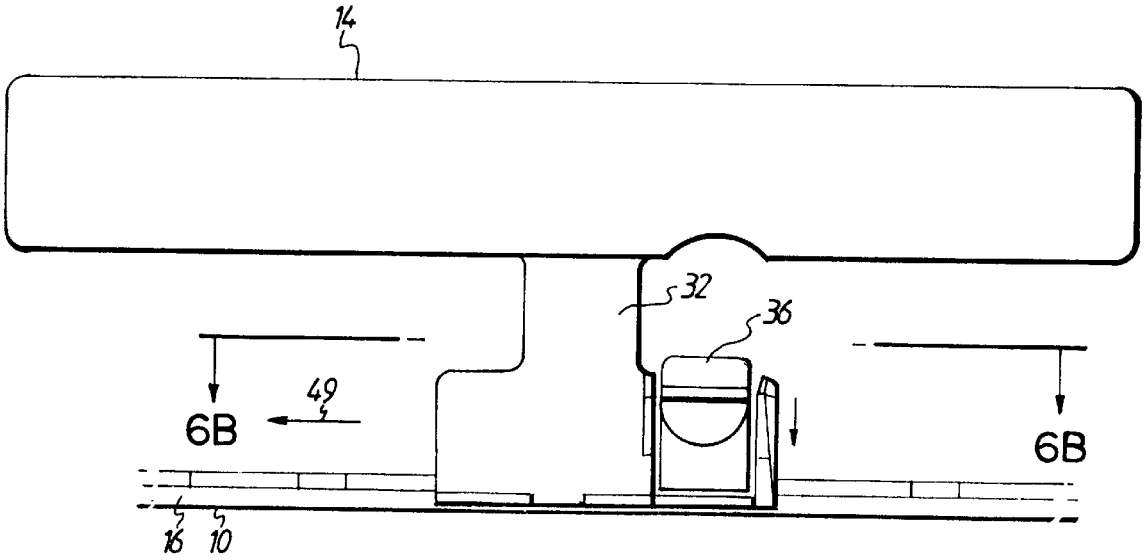
FIGS. 6A and 6B are schematic front and sectional illustrations of the anchor fitting of FIG. 4 in a fully mounted position on the pallet.
Figure 6B:
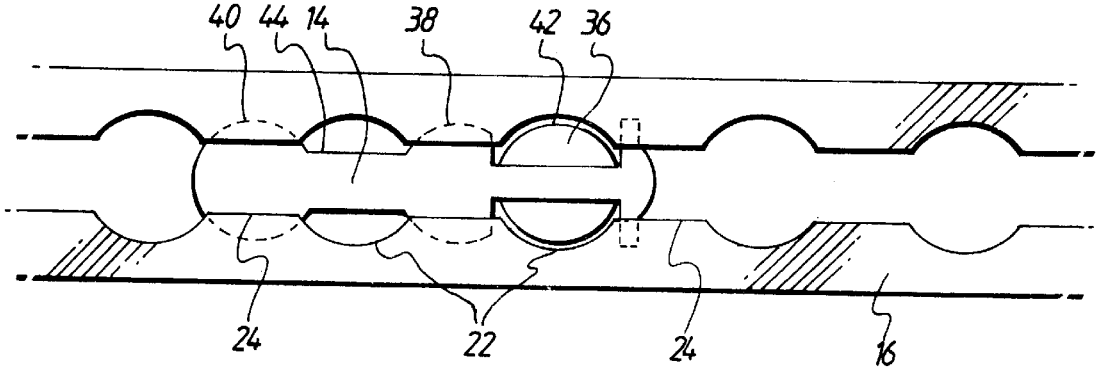

Referring now to FIGS. 6A and 6B, in order to firmly anchor the fitting 14 to track 16 of pallet 10, the fitting 14 is moved longitudinally along the track 16, as indicated by arrow 49, until key portion 42 of plug 36 is brought into registration with a circular opening 22 of the track 16. On release of plug 36, the resilient compression means therein forces it in a generally downward direction such that it engages the opening 22 with which it is in registration. Due to the movement of fitting 14 along the track 16, flange portions 40 and 44 are moved out of phase with openings 22 and 24, so as to prevent removal of fitting 14 from track 16 without first realigning flange portions 40 and 44 with openings 22 and 24. Such realignment is not possible without first disengaging key portion 42 from track 16. Accordingly, in the position illustrated in FIGS. 6A and 6B, fitting 14 is firmly anchored to pallet 10.

It will be appreciated that track 10 and base portion 28 of fitting 14 are configured so as to permit releasable mating engagement therebetween, and so as to provide a secure anchor location for flexible covering 20. It will further be appreciated, however, that pallet 10 may be provided with any alternatively configured track, or indeed, any alternatively configured mounting portion, and that a fitting for use in the present invention may also be alternatively configured, so long as the respective configurations of a track or mounting portion of pallet 10 and an engagement portion of fitting 14 provide for a secure engagement therebetween so as to provide an anchor location for a flexible covering in accordance with the present invention.

Similarly, the T-shape of the upper portion of anchor fitting 14 is also for example only, and the upper portion of a suitable anchor fitting may also be alternatively configured, so long as there is provided a hook-type configuration about which flexible covering 20 may be stretched, and a recessed portion into which a portion of the flexible covering may be tucked, thereby to provide a firm anchoring of the covering 20.

Figure 7:
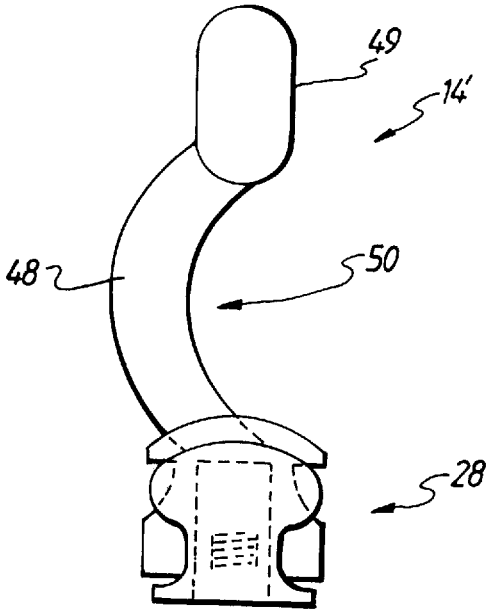
FIG. 7 is a schematic illustration of an anchor fitting constructed in accordance with a further embodiment of the invention.

Accordingly, and referring now Lo FIG. 7, there is illustrated an anchor fitting 14', constructed in accordance with an alternative embodiment of the invention. In the illustrated embodiment, anchor fitting 14' is provided with a generally curved hook member 48 which defines a grip surface 49 and a recessed portion 50.

Figure 8:
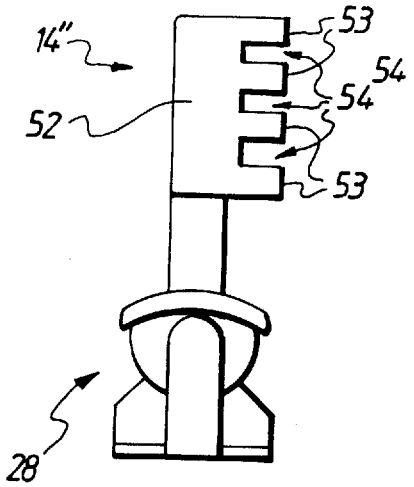
FIG. 8 is a schematic illustration of an anchor fitting constructed in accordance with an additional embodiment of the invention.

Referring now briefly to FIG. 8, there is provided a further anchor fitting 14" which comprises a hook portion 52 defining a plurality of grip surfaces 53 interspersed by a plurality of recesses 54 so as to increase the grip on flexible covering 20.

Figure 9:
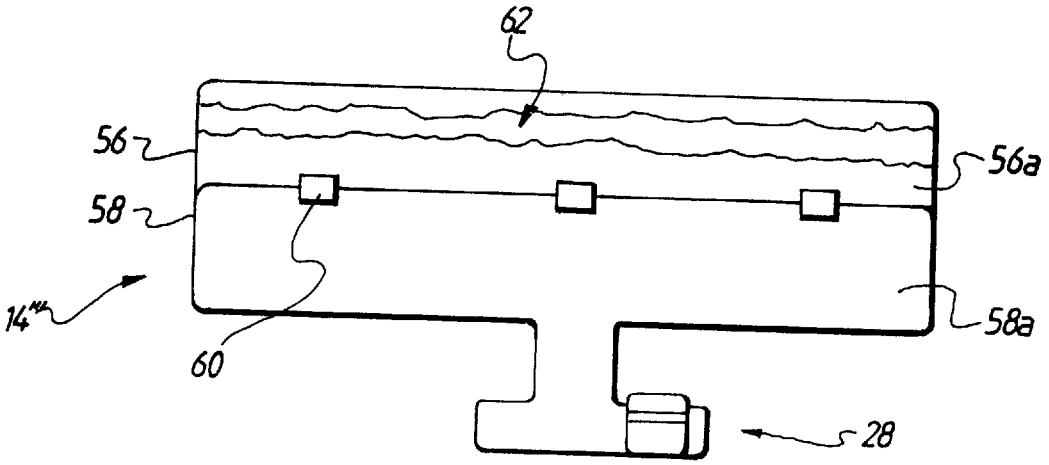
FIG. 9 is a schematic illustration of an anchor fitting constructed in accordance with yet a further embodiment of the invention.

In FIG. 9 there is shown an articulated fitting 14'" which has a first grip member 56 having a first grip surface 56*a*, a second grip member 58 having a second grip surface 58*a*, and hinges 60 which permit folding of first grip member 56 so as to increase or decrease a flexible covering gripping surface as required. Grip surface 56*a* of first grip member 56 may be corrugated or have recesses, as indicated generally at 62, so as to further increase the gripping force between the fitting 14'" and the flexible covering 20.

According to one embodiment of the invention, the cargo 12 (FIGS. 1A and 1B) is wrapped with flexible covering 20 by use of a robot 70 (FIG. 10), such as known for wrapping cargo on nonmetal pallets having channel portions therebeneath.

Figure 10:
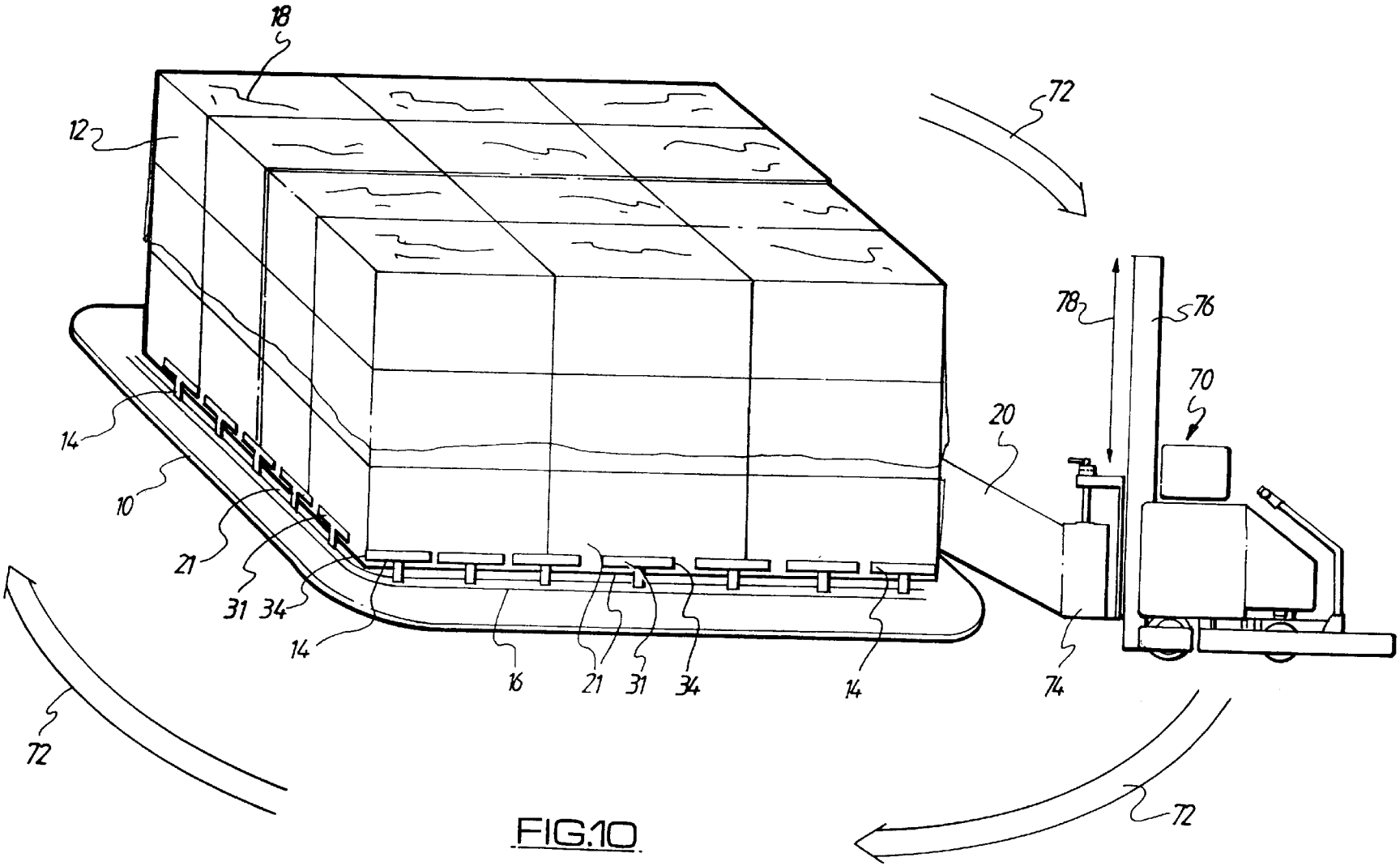
FIG. 10 is a schematic representation of a method of securing cargo to a planar sheet air cargo pallet in accordance with an embodiment of the present invention.

Reference is now made to FIG. 10, in which is illustrated a method of securing cargo 12 to pallet 10 in accordance with a preferred embodiment of the invention. As seen in the drawing, the cargo 12 and pallet 10 are stationary, and the robot 70 is mobile, circling around the pallet 10 as depicted schematically by arrows 72, while winding the flexible covering 20 dispensed from a reel 74, around the fittings 14 and cargo 12. In order to enable a generally helical winding motion of the film 20, the reel 74 is adapted for selectable upward and downward movement along a robot support arm 76 as indicated by arrow 78.

An example of a robot suitable for applying the flexible covering is the ROBOPAC(R) T model robot, manufactured by ROBOPAC. s.a. SAN MARINO, 47031 FALCIANO, Strada Rovereta 27, ITALY.

In an embodiment wherein flexible covering is a plastic stretch film, the thickness of the stretch film used may be in the range 20–70 microns.

The number of times the covering is wound around the cargo and the fitting will depend on the tensile strength and stretchability of the covering material used, the weight of the cargo, and what forces the cargo may be required to withstand when in flight. It has been found that, when using stretch film of thickness in the above-mentioned range, the film should be wound around the cargo and pallet between one to ten times and, more preferably, between two and five times.

According to a preferred embodiment of the invention, the cargo 12 is first covered with top covering 18 (FIG. 1A). This not only provides simple mechanical protection, but, more importantly, also helps to prevent the cargo from shifting in response to sudden acceleration, pitching or rolling of an aircraft shipping the cargo.

The covering 20 is then wound around the cargo and fittings, first around downwardly extending portions of top covering 18 this overhanging plastic sheet and then around the rest of the cargo and fittings as necessary.

In accordance with an alternative embodiment of the invention, the robot may be of the stationary kind, in which case the pallet loaded with cargo is placed on a turntable and as the pallet turns, the robot releases the flexible covering 20, wrapping it around the fittings and the cargo slightly diagonally, so that the covering is also wound about the very top of the cargo.

Figure 11A:
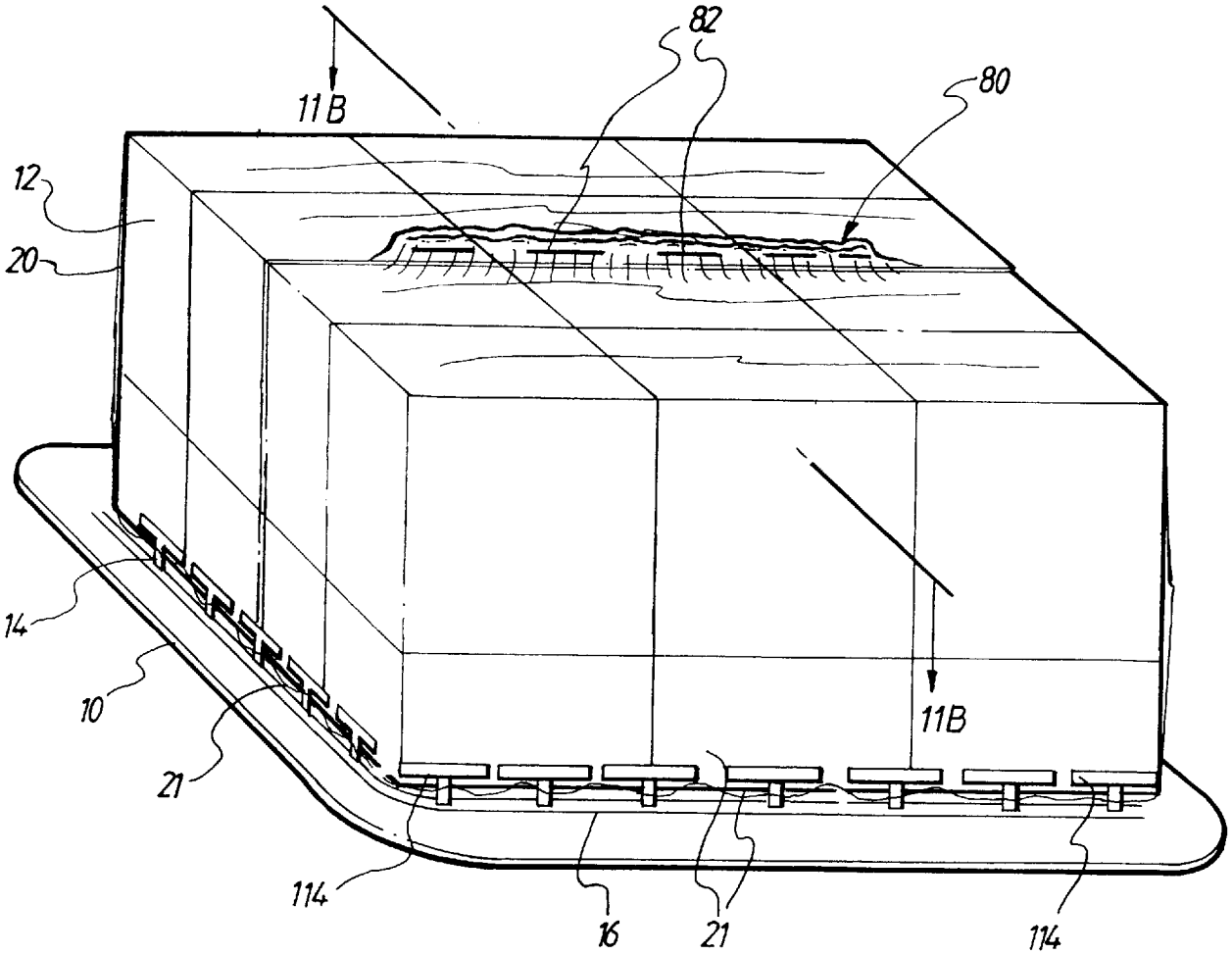
FIG. 11A is a general view of cargo secured to a flat metal pallet in accordance with a further embodiment of the present invention.
Figure 11B:
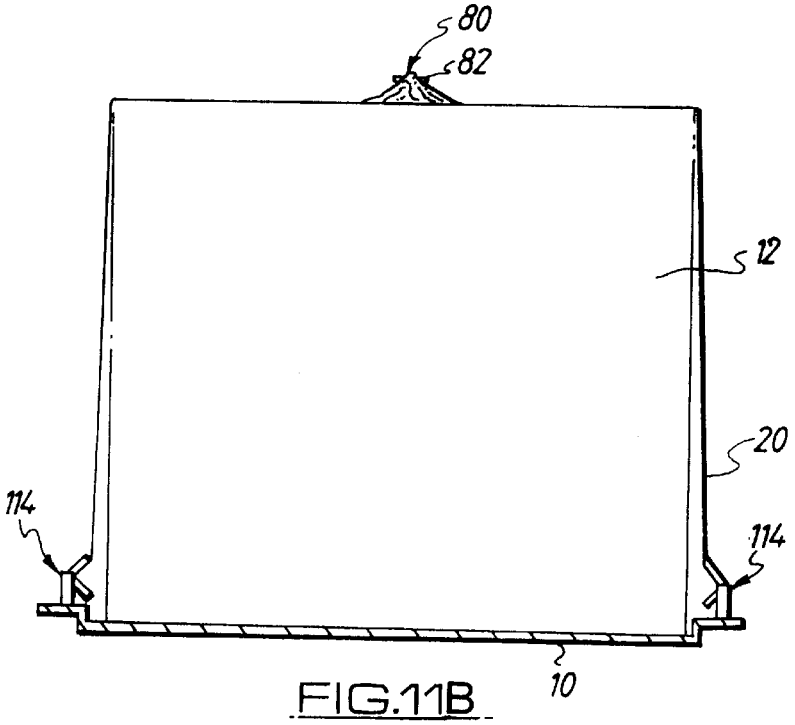
FIG. 11B is a generalized cross-sectional view of the cargo and pallet of FIG. 11A, taken along line 11B—11B therein.
Figure 13:
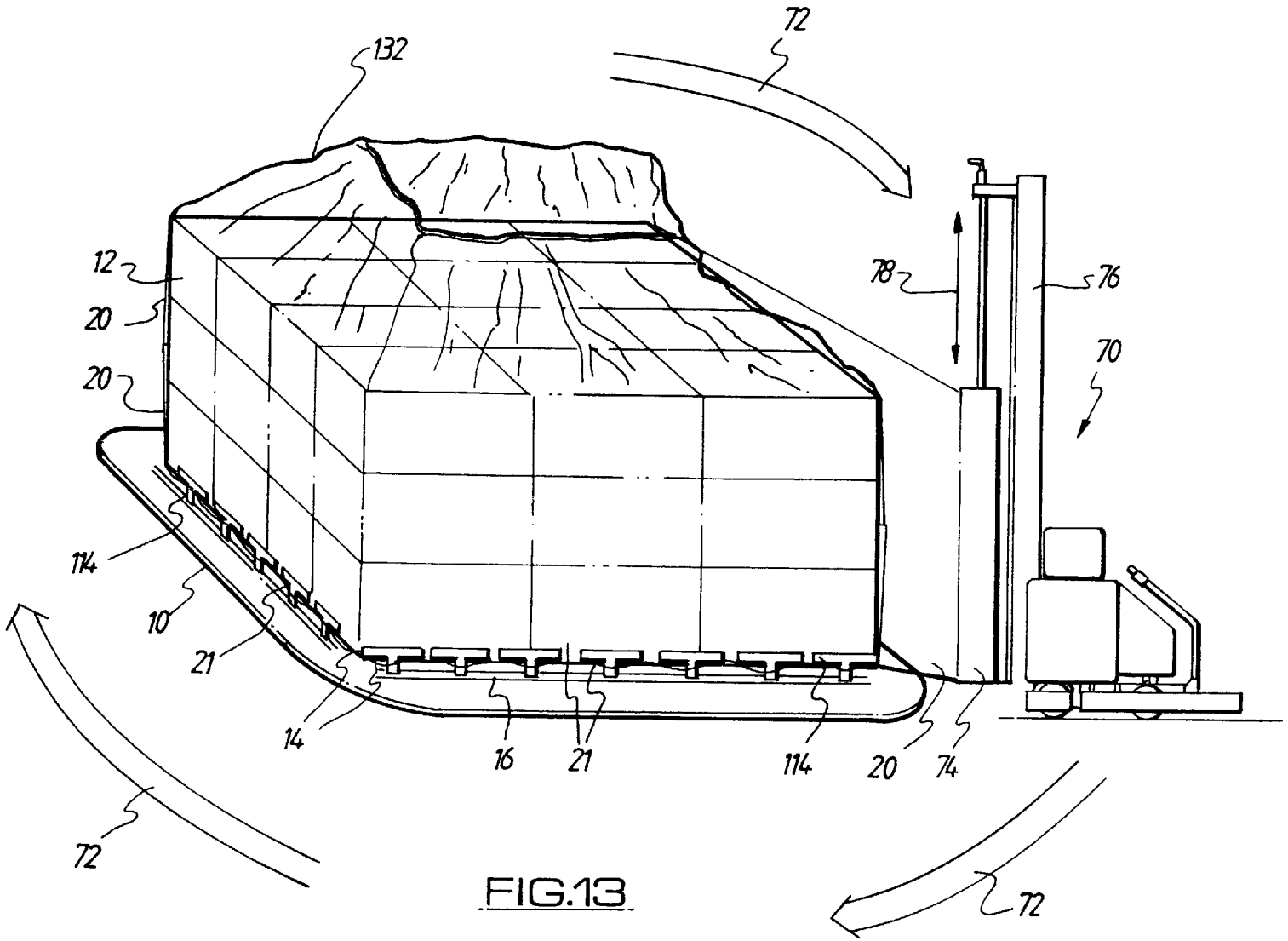
FIG. 13 is a schematic representation of an alternative method of securing cargo to a planar sheet air cargo pallet in accordance with the present invention.

Reference is now made to FIGS. 11A and 11B, in which is illustrated a pallet 10 on which cargo 12 is located and secured by means of flexible covering 20 in accordance with a further embodiment of the invention. According to the present embodiment, a top covering 18 (FIGS. 1A and 1B) is not provided. Rather, flexible covering 20 is wound about cargo 12 and fittings 114, substantially as depicted in FIG. 13, so as to cover the cargo 12 entirely. Top edges 80 of the covering 20 are gathered as shown, and fastened together by any suitable fastening means 82. Typically, fastening means 82 may be staples, as indicated in the drawings.

Figure 12A:
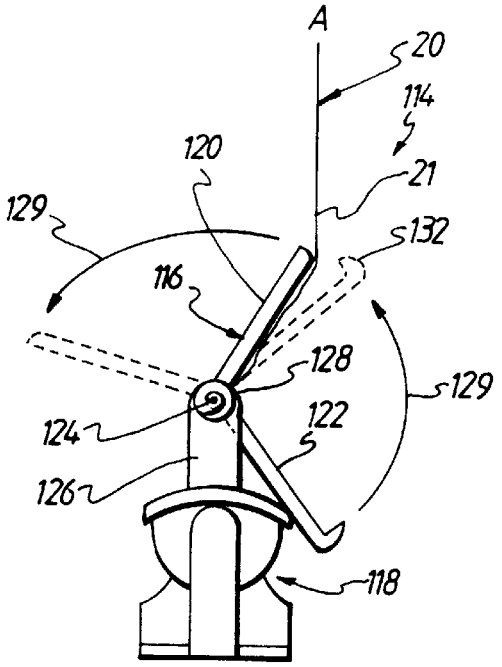
FIGS. 12A and 12B are schematic side views of an anchor fitting in respective disengaged and fully engaged gripping positions, constructed and operative in accordance with the embodiment of FIG. 11B.
Figure 12B:
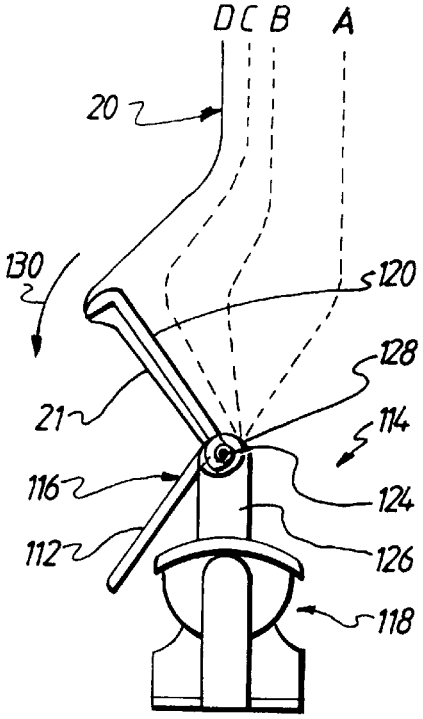

Referring now to FIGS. 12A and 12B, there is shown an anchor fitting 114, constructed in accordance with a further embodiment of the invention, in respective disengaged and fully engaged gripping positions. Anchor fitting 114 comprises a gripping member 116 adapted, as described to grip a portion of covering 20 when engaged thereby, and a base portion 118. Base portion 118 is similar to base portion 28 of anchor fitting 14 (FIGS. 1A–1C) and is thus not described again herein.

Gripping member 116 is a preferably rigid channel-shaped member which defines first and second arms, respectively referenced 120 and 122. Member 116 is arranged for pivoting about a longitudinal pivot axis 124, and is mounted onto an upwardly extending support member 126 formed with base portion 118, via a rotation spring shown schematically at 128.

Initially, as shown in FIG. 12A, gripping member 116 is held in a disengaged position, via any suitable indexing means (not shown), such that first arm 120 is raised and faces generally out and down, and second arm 122 is lowered and faces generally out and up. Typically, an angular clearance of greater than 90 degrees is provided therebetween so as to enable unimpeded engagement of first arm 120 by a bottom edge portion 21 of flexible covering 20.

Accordingly, when flexible covering 20 is initially wound around cargo 10, first arm 120 is engaged by a bottom edge portion 21 of flexible covering 20 so as to cause an initial pivoting of gripping member 116 in the direction indicated by arrows 129 in FIG. 12A. This causes release of gripping member 116 from the indexing means, and spring 128 is operative to urge a further, rapid pivoting of gripping member 116 such that second arm 122 engages covering 20 so as to pull it generally in and down, and shown by arrow 130 (FIG. 12B) thereby tensioning the covering. Preferably, second arm 122 has a hook like protrusion 132 formed on the free end thereof, thereby to increase the gripping force applied to covering 20. Various positions of covering 20 between the initial position of engagement with gripping member 116 are indicated schematically at A, B, C and D.

It will be appreciated that the particular structure of gripping member 116 as shown and described in conjunction with FIGS. 12A and 12B is but one example of an anchor fitting wherein means are provided to 'actively' grip covering 20, and that other suitable 'active' grip members may be employed in accordance with alternative embodiments of the invention.

Referring now briefly to FIG. 13, there is shown a method of securing cargo to an air cargo pallet in accordance with the embodiment of FIGS. 11A–12B. As seen in the drawing, the method is similar to that described above in conjunction with FIG. 13, except that, in accordance with the present embodiment, the robot 70 is provided with a reel 74 that contains a covering 20 that has a width which approximates to the height of the cargo 12. Accordingly, fewer windings of the covering 20 about the cargo are required, and the winding is terminated so as to provide a substantial covering portion 132 extending above the top of the cargo. Portion 132 is then gathered and secured, such as by staples, indicated at 82 in FIGS. 11A and 11B.

It will be appreciated by persons skilled in the art that the scope of the present invention is not limited to what has been particularly shown and described above by way of example. Rather, the scope of the present invention is limited solely by the claims, which follow.

We claim:

1. A cargo restraint system comprising:

a planar pallet having edge portions and mounting means located along said edge portions;

a wrap around tensionable flexible covering placed tightly around in movement restraining contact with the cargo located on said pallet; and a plurality of anchors adapted for mating engagement with said mounting means of said pallet, and having at least one grip surface shaped to directly grip a lower edge portion of said tensionable covering wrapped around the cargo and extended across said anchors after said anchors have been placed in mating engagement with said mounting means thereby to anchor said covering to said pallet, so as to maintain the cargo in a preselected position on said pallet.

2. A system according to claim 1, wherein said anchors further comprise means for applying a tension force to said tensionable flexible covering.

3. A system according to claim 2, wherein said means for applying a tension force comprises means for applying a generally downward tension force to said tensionable flexible covering in response to engagement thereby.

4. A system according to claim 2, wherein said means for applying a tension force comprises a gripping member which is adapted to pivot in response to an initial force applied thereto by said covering, thereby to apply a generally downward tension force thereto.

5. A system according to claim 1, wherein said wrap around tensionable covering comprises a plurality of layers of said covering.

6. A system according to claim 5, wherein said plurality of layers comprises a number of layers in the range 2 to 5.

7. A system according to claim 1, and wherein said anchors further comprise a locking element for releasable locking engagement with said mounting means.

8. A system according to claim 1, and wherein said grip surface of said anchors further comprises an outwardly facing hook portion defining an outwardly facing recessed portion adapted to receive tucked-in planar edge portions of said tensionable flexible covering laid over said grip surface.

9. A system according to claim 1, wherein said anchors further comprise a plurality of fittings, each fitting defining a generally outwardly-facing grip surface and a recessed portion, said grip surface and recessed portion together adapted to tightly engage edge portions of said tensionable flexible covering so as to anchor of said covering to said pallet.

10. A system according to claim 1, wherein said tensionable flexible covering comprises a covering material having a thickness in the range 20 to 70 microns.

11. A system according to claim 1, wherein said tensionable flexible covering has a generally uniform texture.

12. A system according to claim 1, wherein said tensionable flexible covering comprises plastic stretch film, woven flexible sheet material, non-woven flexible sheet material or webbing.

13. Apparatus for anchoring a wrap around tensionable flexible covering to edge portions of a planar sheet pallet adapted in use to support cargo thereon and having edge portions, the tensionable flexible covering being retained in movement restraining contact with the cargo, said apparatus comprising:

a track for positioning along the edge portions of a planar sheet pallet; and a plurality of anchors adapted for mating engagement with said track, said anchors each having at least one grip surface shaped to directly grip a lower edge portion of a tensionable covering extended across said grip surface after said anchors have been placed in mating engagement with said track thereby to anchor the covering to the pallet and thereby to maintain cargo located thereon in a preselected position.

14. Apparatus according to claim 13, wherein said anchors further comprise a locking element for releasable locking engagement with said track.

15. Apparatus according to claim 13, wherein said grip surface further comprises an outwardly facing hook portion defining an outwardly-facing recessed portion shaped to receive tucked-in planar edge portions of the tensionable flexible covering laid over said grip surface.

16. Apparatus according to claim 13, wherein said said anchors further comprise a plurality of fittings, each fitting defining generally an outwardly-facing grip surface and a recessed portion, said outwardly-facing grip surface and said recessed portion together adapted in use to tightly engage edge portions of said tensionable flexible covering.

17. Apparatus according to claim 13, wherein said anchors further comprise means for applying a tension force to said tensionable flexible covering.

18. Apparatus according to claim 17, wherein said means for applying a tension force comprises means for applying a generally downward tension force to said tensionable flexible covering in response to engagement thereby.

19. Apparatus according to claim 17, wherein said means for applying a tension force comprises a gripping member which is adapted in use to pivot in response to an initial force applied thereto by said covering, thereby to apply a generally downward tension force thereto.

20. A fitting for anchoring a tensionable flexible covering to a planar sheet pallet in movement restraining contact with a cargo located on the pallet, said fitting comprising:

a base portion shaped for mating engagement with a selected mounting portion of a planar sheet pallet; and gripping means attached to said base portion, said gripping means having at least one grip surface shaped to directly grip a lower edge portion of a tensionable covering extended across said grip surface after said base portion is engaged with the selected mounting portion of the pallet thereby to anchor the covering to the pallet, so as to maintain the cargo in a preselected position on the pallet.

21. A fitting according to claim 20, wherein said gripping means has a generally outwardly-facing hook-like configuration, and said base portion is shaped for mounting said fitting such that said grip surface is arranged in a generally outward-facing orientation relative to the pallet, thereby to grippingly engage in use a lower edge portion of the tensionable flexible covering laid over said grip surface.

22. A fitting according to claim 20, wherein said base portion comprises a locking element for locking said fitting to a selected mounting portion of the pallet.

23. A fitting according to claim 20, wherein said gripping means is shaped to apply a generally downward tension force to the tensionable flexible covering.

24. A fitting according to claim 20, wherein said gripping means is shaped to apply a generally downward tension force to the tensionable flexible covering in response to engagement thereby.

25. A fitting according to claim 24, wherein said gripping means comprises a gripping member which is adapted in use to pivot in response to an initial force applied thereto by said covering, thereby to apply said generally downward tension force thereto.

26. A method of securing a cargo to a planar sheet pallet so as to withstand forces seeking to dislodge the cargo therefrom when the pallet is in motion, said method comprising the steps of:

placing cargo on to the pallet;

arranging a plurality of anchor fittings, each anchor fitting having one or more grip surfaces, along predetermined peripheral portions of the pallet externally of the cargo;

wrapping a tensionable flexible covering around the cargo and across the trip surfaces of the anchor fittings, after the anchor fittings have been arranged on the pallet, so as to be in movement restraining contact with the cargo, and so as to cause direct gripping engagement of a lower edge portion of the tensionable flexible covering by the grip surfaces of the anchor fittings, thereby restraining the cargo on the pallet against dislodgement forces when in motion.

27. A method according to claim 26, wherein the anchor fittings are hooked-shaped fittings and said step of arranging comprises the step of arranging the hook-shaped fittings on the pallet in an outward-facing orientation.

28. A method according to claim 26, wherein said step of wrapping comprises the step of wrapping by use of a robot.

29. A method according to claim 26, wherein said step of wrapping comprises the step of winding the tensionable flexible covering around the cargo and fittings so as to leave a portion of the covering protruding above the top of the cargo, said method also comprising the additional steps of:

gathering together the portion of the covering protruding above the top of the cargo, and fastening together the gathered portion so as to secure the cargo to the pallet.

30. A method according to claim 26, wherein said step of wrapping comprises the step of wrapping a plurality of layers of the tensionable covering around the cargo and over said anchor fittings.

31. A method according to claim 30, wherein said step of wrapping comprises the step of wrapping around the cargo and over said anchor fittings a number of layers in the range 2 to 5.

* * * * *

UNITED STATES PATENT AND TRADEMARK OFFICE

CERTIFICATE OF CORRECTION

PATENT NO. : 5,772,369
DATED : June 30, 1998
INVENTOR(S) : Shmuel LERMAN

It is certified that error appears in the above-identified patent and that said Letters Patent is hereby corrected as shown below:

Title page, [73], Assignee, change "S.F.A. ENGINEERING 92 LTD." to --S.F.A ENGINEERING 92 LTD.--.

Signed and Sealed this

Twenty-third Day of March, 1999

*Attest:*

Q. TODD DICKINSON

*Attesting Officer*

*Acting Commissioner of Patents and Trademarks*